US007300188B2

(12) United States Patent
Tseng

(10) Patent No.: US 7,300,188 B2
(45) Date of Patent: Nov. 27, 2007

(54) STRUCTURE FOR ASSEMBLING A BULB HOLDER WITH AN OUTER SHADE

(76) Inventor: Ming-chi Tseng, No. 18, Jhensing E. St., Wufong Township, Taichung County (TW)

( * ) Notice: Subject to any disclaimer, the term of this patent is extended or adjusted under 35 U.S.C. 154(b) by 110 days.

(21) Appl. No.: 11/378,430

(22) Filed: Mar. 20, 2006

(65) Prior Publication Data

US 2007/0217228 A1 Sep. 20, 2007

(51) Int. Cl.
*F21S 8/06* (2006.01)

(52) U.S. Cl. ..... 362/408; 362/454; 362/147

(58) Field of Classification Search ..... 362/403, 362/408–409, 147, 433, 453–454; D26/72, D26/83, 85, 118
See application file for complete search history.

(56) References Cited

U.S. PATENT DOCUMENTS 5,988,062 A * 11/1999 Kikuchi ..... 101/128.4
D436,211 S * 1/2001 Neeld et al. ..... D26/85
2002/0070360 A1* 6/2002 Machi ..... 250/504 R
2002/0136000 A1* 9/2002 Hung ..... 362/147

* cited by examiner

*Primary Examiner*—Ali Alavi
(74) *Attorney, Agent, or Firm*—Rosenberg, Klein & Lee

(57) ABSTRACT

A structure for assembling a bulb holder with an outer shade, including an outer shade and a bulb holder. The outer shade is formed with a central through hole through which a hollow tube is passed. The hollow tube has an outer connecting section on which a locating member is disposed. The bulb holder includes a fixing seat and a base seat for connecting with a bulb. Several support posts axially extend from a circumference of the fixing seat. Each support post has a free end from which a stopper section radially extends. The fixing seat is formed with an inner connecting section with which the outer connecting section of the hollow tube is connected for locating the outer shade between the fixing seat and the locating member. The base seat has an open end distal from the fixing seat. A circumferential wall of the open end of the base seat is formed with multiple recesses in which the stopper sections of the fixing seat are inlaid and located. The bulb holder can be axially moved and conveniently assembled with or disassembled from the outer shade.

4 Claims, 8 Drawing Sheets

STRUCTURE FOR ASSEMBLING A BULB HOLDER WITH AN OUTER SHADE

BACKGROUND OF THE INVENTION

The present invention is related to a structure for assembling a bulb holder with an outer shade. By means of the assembling structure, the bulb holder can be axially moved and conveniently assembled with or disassembled from the outer shade.

FIG. 8 shows a conventional structure for assembling a bulb holder 6 with an outer shade 5. The outer shade 5 is formed with a through hole 51. A hollow tube 52 formed with outer thread is passed through the through hole 51. The bulb holder 6 has a top end formed with a thread hole 61 in which the tube 52 is screwed. A nut 53 is screwed on the outer thread of the tube 52 for fixing the outer shade 5. A bulb 7 is connected with a bottom end of the bulb holder 6. One end of a wire 62 is fixedly connected with the bulb holder 6. The other end of the wire 62 is conducted through the tube 52 to connect with a power supply.

When assembled, a user first holds the bulb holder 6 with one hand and continuously rotates the bulb holder 6 to screw the tube 52 into the thread hole 61 of the top end of the bulb holder 6. However, the wire 62 is fixedly connected with the bulb holder 6. Therefore, when continuously rotating the bulb holder 6, the wire 62 tends to tangle and loosen or even detach from the contacts inside the bulb holder 6. Moreover, when continuously rotating the bulb holder 6, the wire 62 will tangle and abrade the inner wall face of the tube 52. As a result, the skin of the wire 62 is easy to wear out. This may lead to short circuit and cause a fire.

SUMMARY OF THE INVENTION

It is therefore a primary object of the present invention to provide a structure for assembling a bulb holder with an outer shade. The bulb holder can be axially moved and conveniently assembled with or disassembled from the outer shade. When assembled with the outer shade, the bulb holder is rotated. Therefore, the wire is prevented from being tangled and torn and loosened from the conductive plates due to continuous rotation. Also, the skin of the wire is protected from wearing out due to abrasion so as to avoid short circuit and possible fire accident.

According to the above object, the structure for assembling the bulb holder with the outer shade includes:

a substantially bowl-shaped outer shade formed with a central through hole, a hollow tube being passed through the through hole, the hollow tube having two open ends, a circumference of the hollow tube being formed with an outer connecting section, a locating member being disposed on the outer connecting section; and a bulb holder including a fixing seat and a base seat for connecting with a bulb, the fixing seat being substantially disc-shaped, several support posts axially extending from a circumference of the fixing seat, each support post having a free end from which a stopper section radially extends, a center of and the locating member, the base seat having an open end distal from the fixing seat, a circumferential wall of the open end of the base seat being formed with multiple recesses in which the stopper sections of the fixing seat are inlaid.

The present invention can be best understood through the following description and accompanying drawings wherein:

DETAILED DESCRIPTION OF THE PREFERRED EMBODIMENTS

Figure 1:
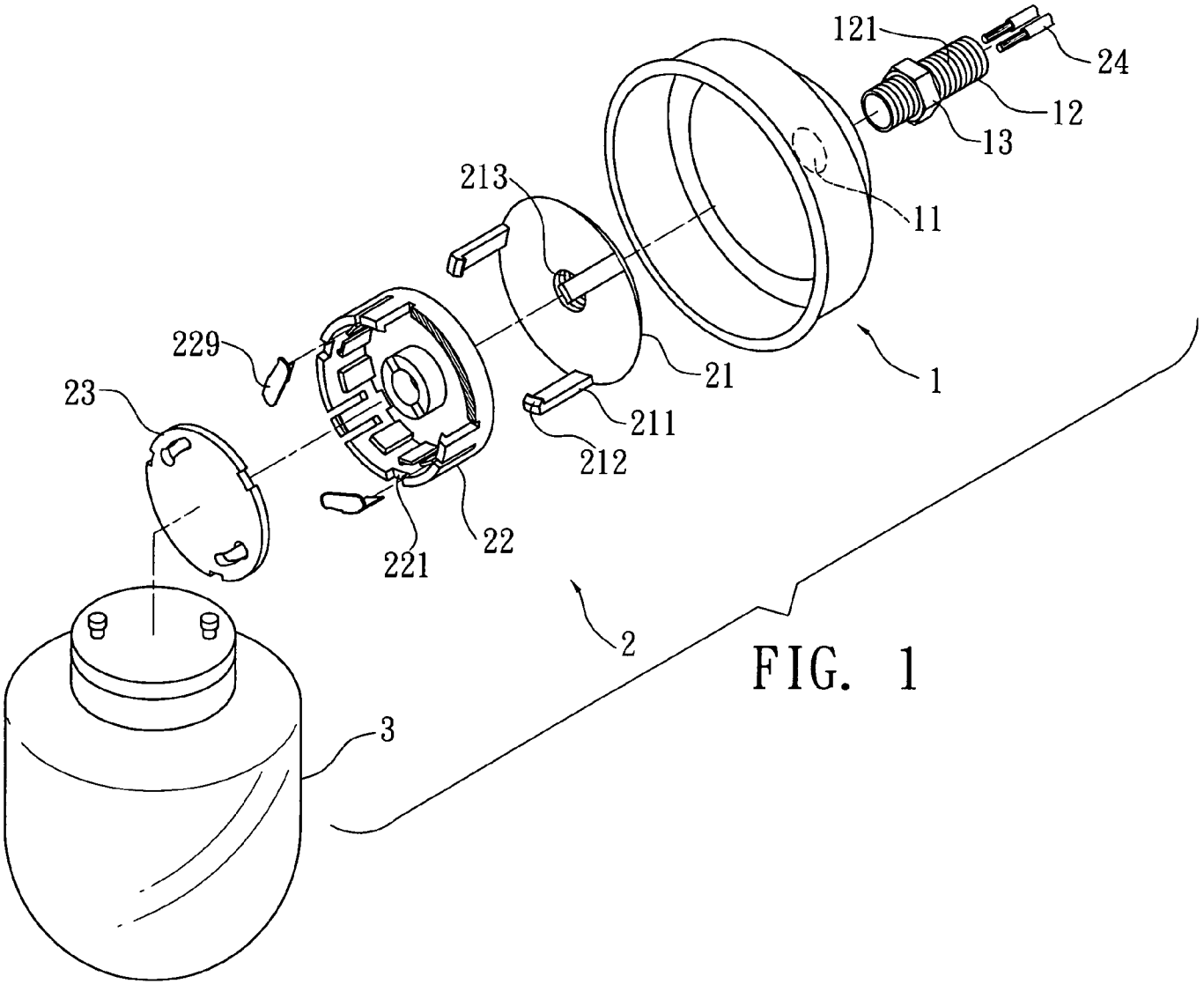
FIG. 1 is a perspective exploded view of a first embodiment of the present invention.
Figure 2:
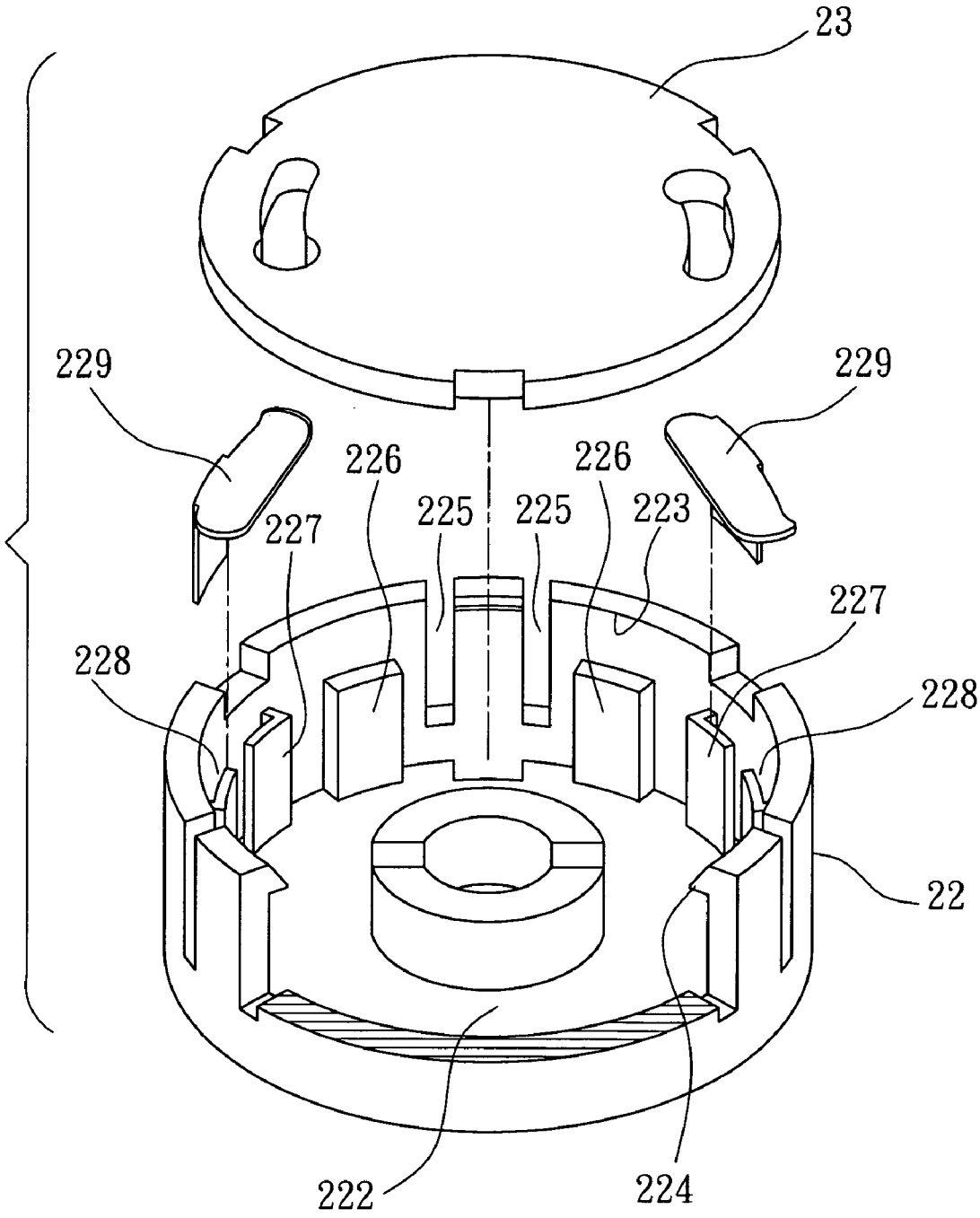
FIG. 2 is a perspective exploded view of the base seat and bottom board of the first embodiment of the present invention.
Figure 3:
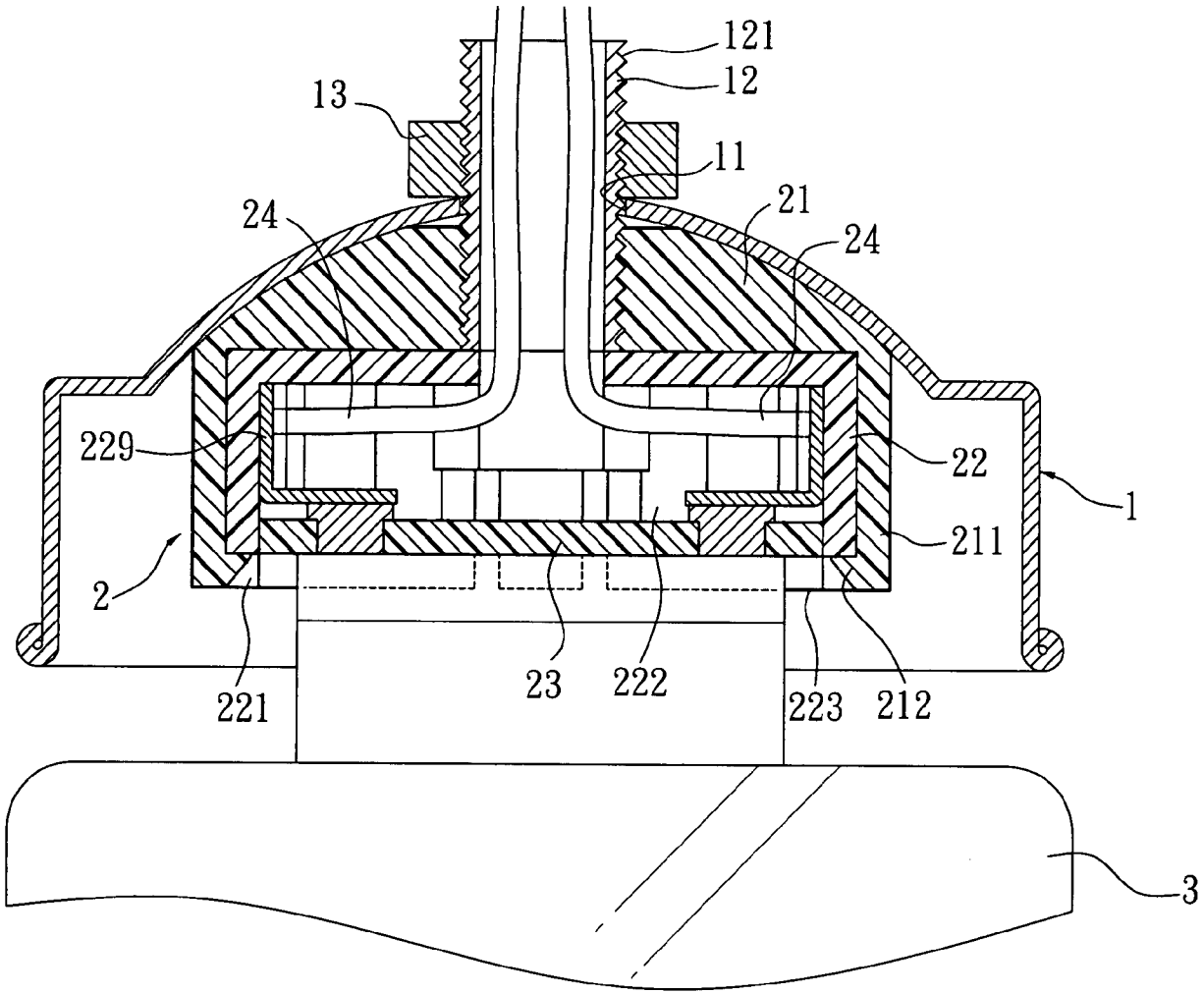
FIG. 3 is a sectional assembled view of the fixing seat and the base seat of the first embodiment of the present invention.
Figure 4:
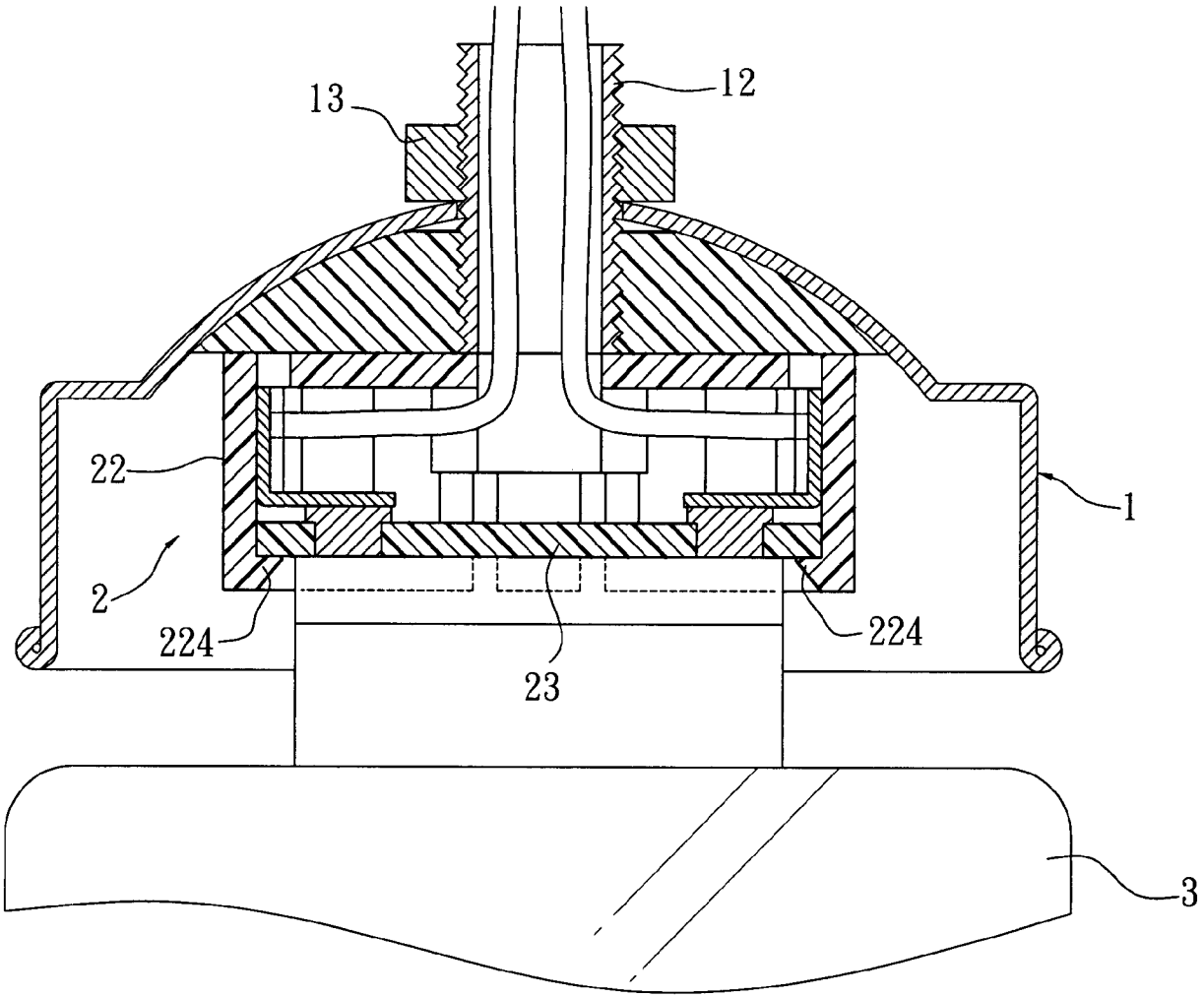
FIG. 4 is a sectional assembled view of the base seat and the bottom board of the first embodiment of the present invention.

Please refer to FIGS. 1 to 4. The structure for assembling the bulb holder with the outer shade of the present invention includes a substantially bowl-shaped outer shade 1 formed with a central through hole 11. A hollow tube 12 is passed through the through hole 11. The hollow tube 12 has two open ends. A circumference of the hollow tube 12 is formed with an outer connecting section 121. In this embodiment, the outer connecting section 121 is an outer thread. A locating member 13 is screwed on the outer connecting section 121. In this embodiment, the locating member 13 is a nut.

The structure for assembling the bulb holder with the outer shade of the present invention further includes a bulb holder 2 including a fixing seat 21 and a base seat 22. The fixing seat 21 is substantially disc-shaped. Several support posts 211 axially extend from a circumference of the fixing seat 21. Each support post 211 has a free end from which a stopper section 212 inwardly radially extends. A center of the fixing seat 21 is formed with an inner connecting section 213. In this embodiment, the inner connecting section 213 is an inner thread in which the outer thread of the hollow tube 12 is screwed for locating the outer shade 1 between the fixing seat 21 and the locating member 13.

The base seat 22 has an open end distal from the fixing seat 21. A circumferential wall of the open end of the base seat 22 is formed with multiple recesses 221 in which the stopper sections 212 of the fixing seat 21 are inlaid. The base seat 22 is formed with a cavity 222 having an opening 223 at the open end. The circumferential wall of the opening of the open end of the base seat 22 is formed with several inwardly radially extending stop sections 224. The circumferential wall of the base seat 22 is formed with two splits 225 respectively on two sides of each stop section 224, whereby the stop section 224 is radially resiliently movable. Several stopper blocks 226 are formed on inner face of the circumferential wall of the base seat 22. The stopper blocks 226 are spaced from the stop sections 224, whereby a bottom board 23 is mounted between the stop sections 224 and the stopper blocks 226. In addition, two extension sections 227 are formed on the inner face of the circumferential wall of the base seat 22 to define two insertion slots 228 in which two conductive plates 229 are inserted. The conductive plates 229 are fixedly connected with one end of a wire 24. The other end of the wire 24 is connected to a power supply.

When assembled, the hollow tube 12 is first passed through the through hole 11 of the outer shade 1 and screwed into the inner thread of the fixing seat 21. Then the fixing seat 21 is fitted onto the base seat 22 along the circumferential wall of the base seat 22 to make the stopper sections 212 of the support posts 211 of the fixing seat 21 inlaid in the recesses 221 of the base seat 22.

According to the above structure, the wire 24 is prevented from being tangled and torn and loosened from the conductive plates 229 due to continuous rotation. Also, the skin of the wire 24 is protected from wearing out due to abrasion so as to avoid short circuit. In addition, the bulb holder 2 can be axially moved and conveniently assembled with or disassembled from the outer shade 1.

Figure 5:
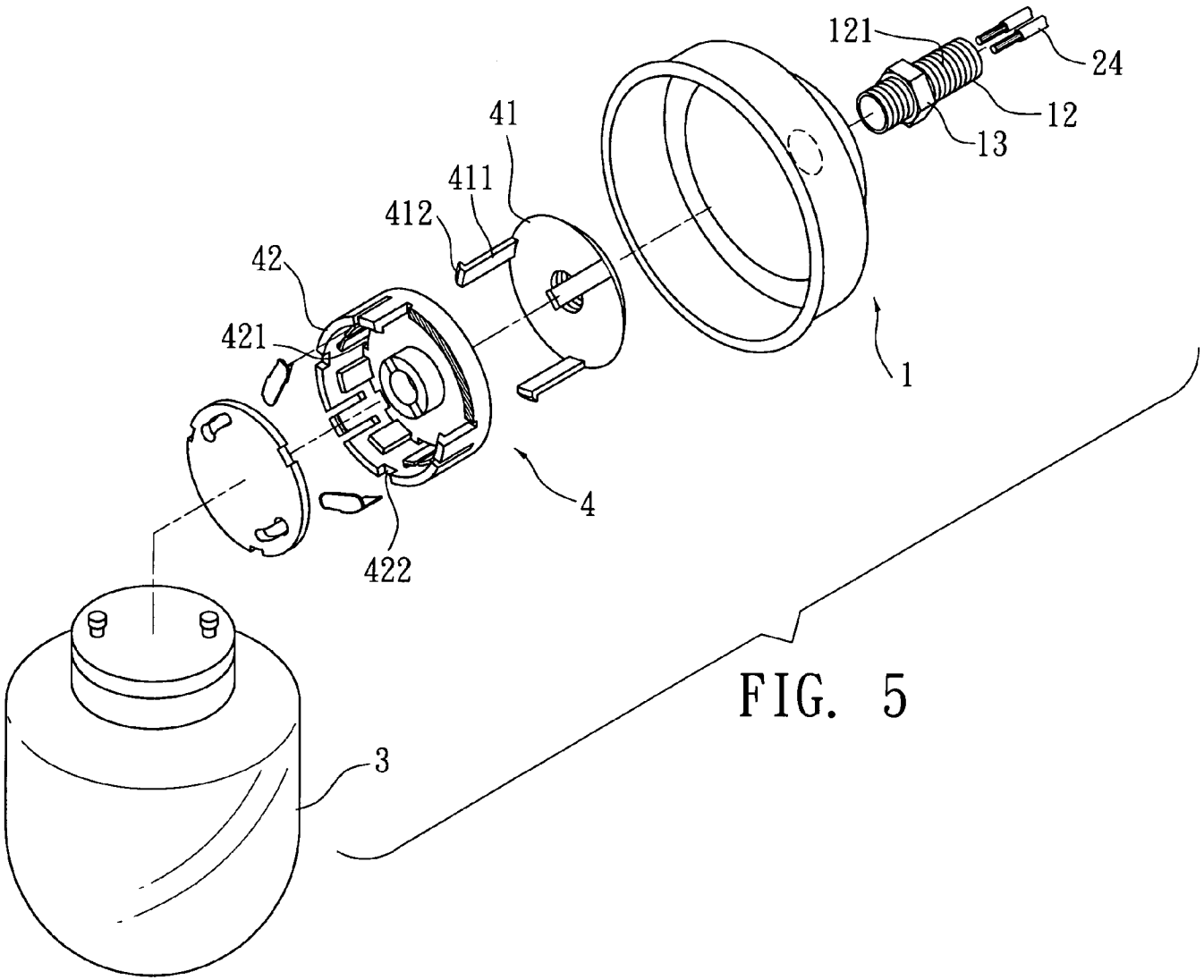
FIG. 5 is a perspective exploded view of a second embodiment of the present invention.
Figure 6:
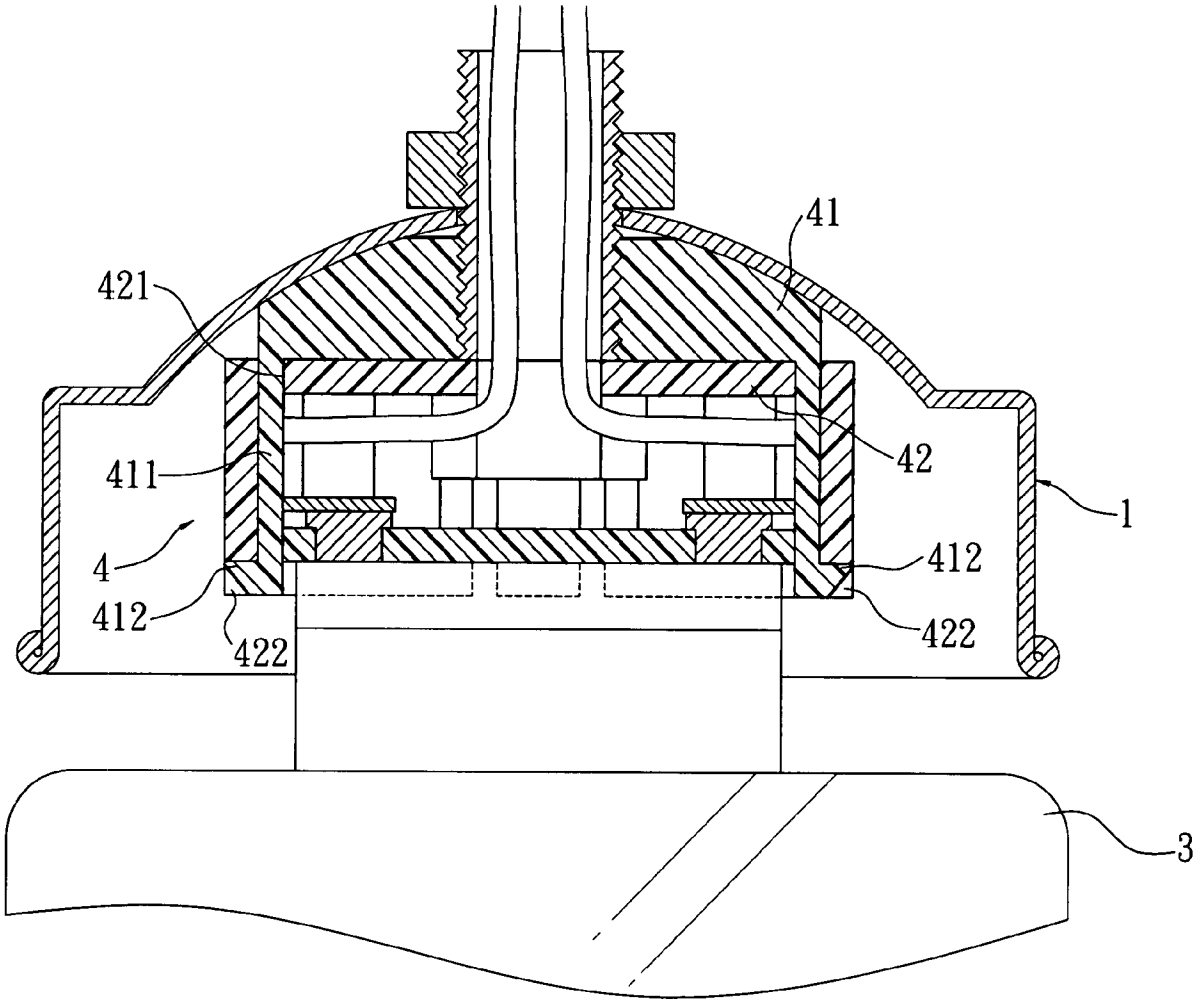
FIG. 6 is a sectional assembled view of the fixing seat and the base seat of the second embodiment of the present invention.
Figure 7:
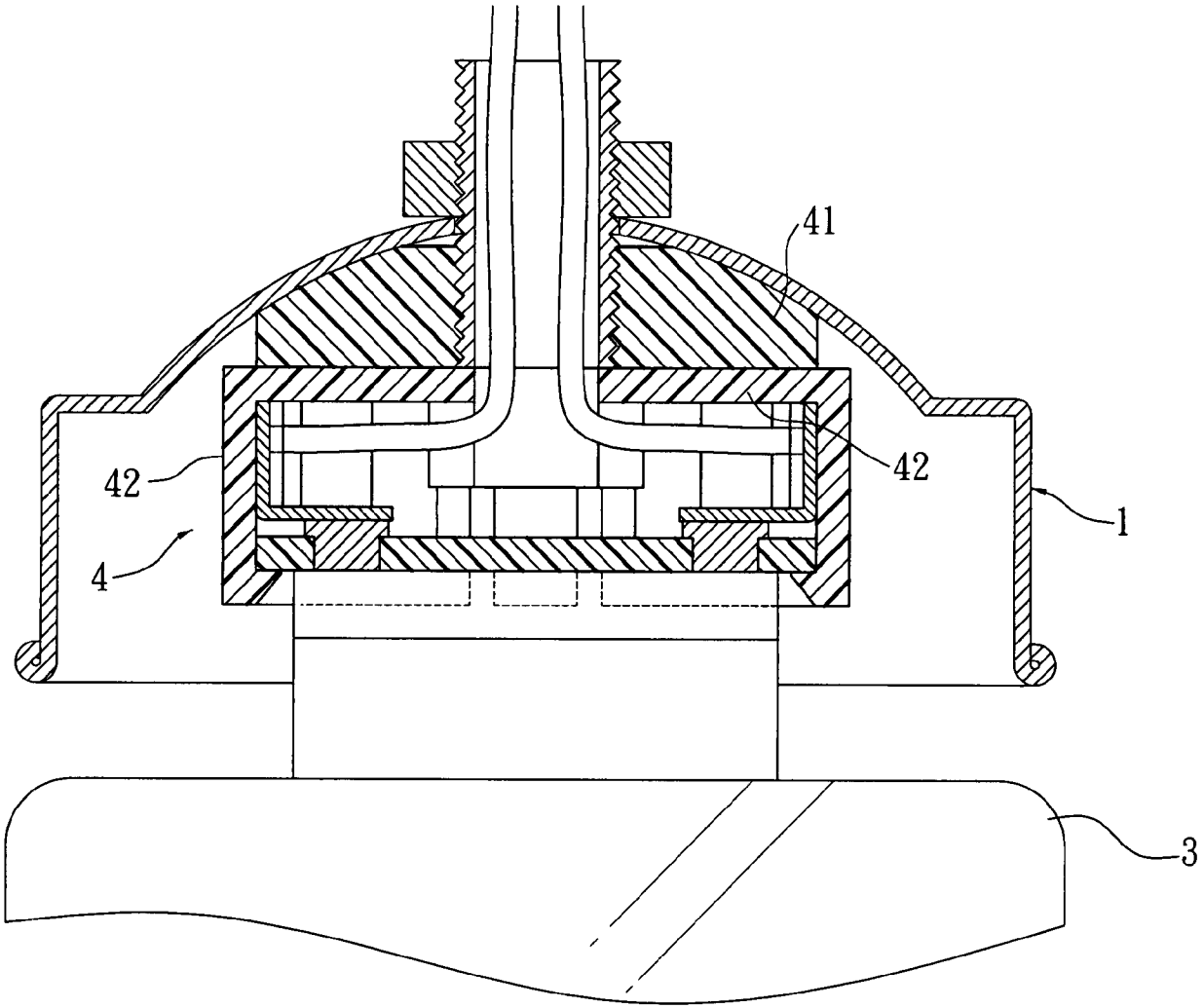
FIG. 7 is a sectional assembled view of the base seat and the bottom board of the second embodiment of the present invention.
Figure 8:
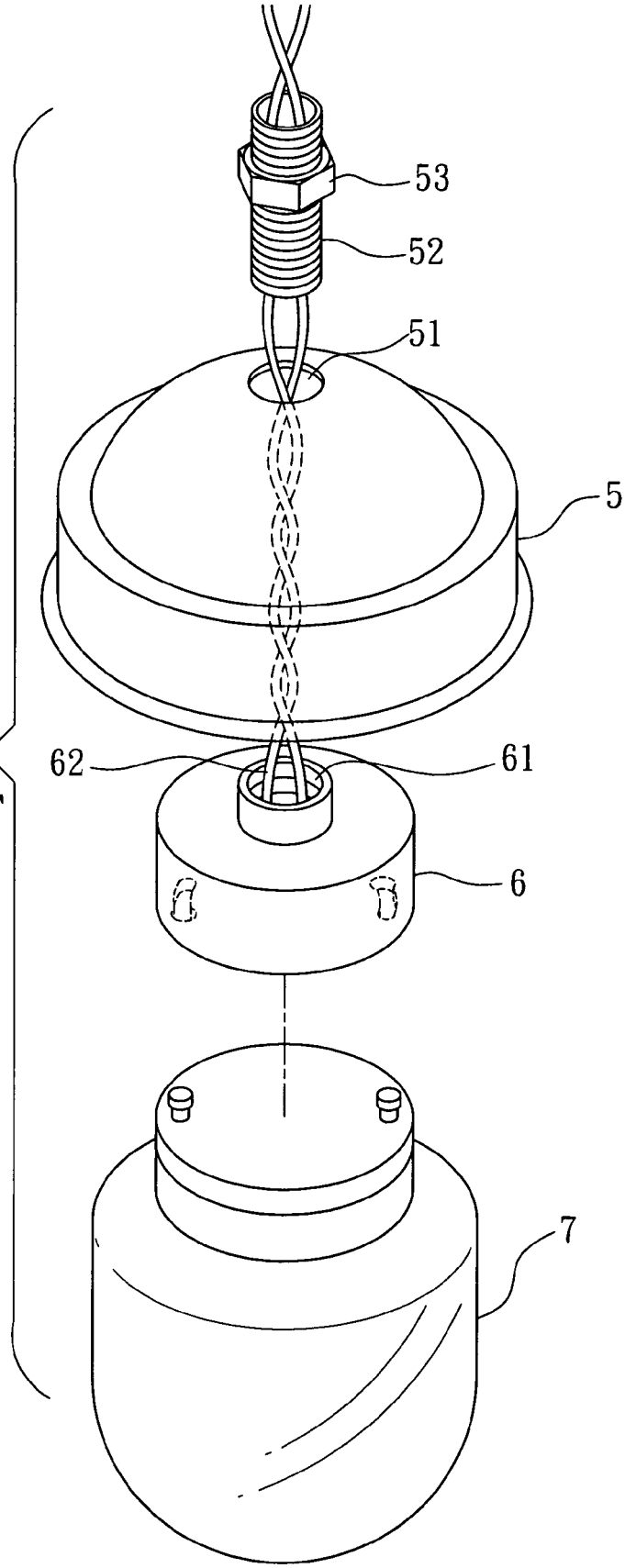
FIG. 8 PRIOR ART
FIG. 8 is a perspective exploded view of a conventional structure for assembling a bulb holder with an outer shade.

FIGS. 5 to 7 show a second embodiment of the present invention, in which one end of the base seat 42 proximal to the fixing seat 41 is formed with several perforations 421. The stopper sections 412 of the support posts 411 of the fixing seat 41 outwardly radially extend from the free ends of the support posts 411. The support posts 411 can be fitted through the perforations 421 of the base seat 42 to make the stopper sections 412 of the support posts 411 inlaid in the recesses 422 of the base seat 42.

According to the structure of the second embodiment, the bulb holder can be also axially moved and conveniently assembled with or disassembled from the outer shade.

The above embodiments are only used to illustrate the present invention, not intended to limit the scope thereof. Many modifications of the above embodiments can be made without departing from the spirit of the present invention.

What is claimed is:

1. A structure for assembling a bulb holder with an outer shade, comprising:

a substantially bowl-shaped outer shade formed with a central through hole, a hollow tube being passed through the through hole, the hollow tube having two open ends, a circumference of the hollow tube being formed with an outer connecting section, a locating member being disposed on the outer connecting section; and a bulb holder including a fixing seat and a base seat for connecting with a bulb, the fixing seat being substantially disc-shaped, several support posts axially extending from a circumference of the fixing seat, each support post having a free end from which a stopper section radially extends, a center of the fixing seat being formed with an inner connecting section with which the outer connecting section of the hollow tube is connected for locating the outer shade between the fixing seat and the locating member, the base seat having an open end distal from the fixing seat, a circumferential wall of the open end of the base seat being formed with multiple recesses in which the stopper sections of the fixing seat are inlaid and located.

2. The structure for assembling the bulb holder with the outer shade as claimed in claim 1, wherein the base seat is formed with a cavity having an opening at the open end of the base seat, the circumferential wall of the opening of the open end of the base seat being formed with several inwardly radially extending stop sections, the circumferential wall of the base seat being formed with two splits respectively on two sides of each stop section, whereby the stop section is radially resiliently movable, several stopper blocks being formed on inner face of the circumferential wall of the base seat, the stopper blocks being spaced from the stop sections, whereby a bottom board is mounted between the stop sections and the stopper blocks, two extension sections being formed on the inner face of the circumferential wall of the base seat to define two insertion slots in which two conductive plates are inserted.

3. The structure for assembling the bulb holder with the outer shade as claimed in claim 1, wherein the stopper sections of the support posts of the fixing seat inwardly radially extend from the free ends of the support posts, whereby the fixing seat can be fitted onto the base seat along the circumferential wall of the base seat to make the stopper sections of the support posts of the fixing seat inlaid in the recesses of the base seat.

4. The structure for assembling the bulb holder with the outer shade as claimed in claim 2, wherein one end of the base seat proximal to the fixing seat is formed with several perforations, the stopper sections of the support posts of the fixing seat outwardly radially extending from the free ends of the support posts, whereby the support posts can be fitted through the perforations of the base seat to make the stopper sections of the support posts inlaid in the recesses of the base seat.

* * * * *